United States Patent [19]

Yoshikawa

[11] 4,243,965

[45] Jan. 6, 1981

[54] DEFLECTION COIL

[75] Inventor: Norio Yoshikawa, Tokyo, Japan

[73] Assignee: Denki Onkyo Co., Ltd., Toyko, Japan

[21] Appl. No.: 884,401

[22] Filed: Mar. 8, 1978

[30] Foreign Application Priority Data

Mar. 8, 1977 [JP] Japan ..... 52-277793[U]

[51] Int. Cl.[3] ..... H01F 7/00

[52] U.S. Cl. ..... 335/213; 335/210

[58] Field of Search ..... 335/210, 212, 213

[56] References Cited

U.S. PATENT DOCUMENTS

| | | | |
|---|---|---|---|
| 3,801,941 | 4/1974 | Phillips | 335/213 |
| 3,878,490 | 4/1975 | Logan | 335/213 |
| 3,895,329 | 7/1975 | Logan et al. | 335/213 X |
| 4,023,129 | 5/1977 | Kratz et al. | 335/213 X |
| 4,070,640 | 1/1978 | Torsch | 335/213 |
| 4,117,432 | 9/1978 | Shizu | 335/213 |

FOREIGN PATENT DOCUMENTS

| | | | |
|---|---|---|---|
| 2601205 | 7/1976 | Fed. Rep. of Germany | 335/213 |

*Primary Examiner*—Harold Broome

*Attorney, Agent, or Firm*—Armstrong, Nikaido, Marmelstein & Kubovcik

[57] ABSTRACT

A deflection coil is provided which comprises a coil frame having a flared coil bobbin and guides provided at the front and rear ends of the coil bobbin and integrated therewith. The guide at the front end of the coil frame has a first plurality of circumferentially spaced coil winding insertion slots therein and the guide at the rear end of the coil frame has a second plurality of circumferentially based coil winding insertion slots therein. The first plurality of slots is greater than the second plurality of slots. The deflection coil further comprises a saddle-type coil along the inside surface of the coil frame which has a plurality of wires passing through predetermined coil winding insertion slots in the guide at the front and rear ends of the coil frame. The saddle-type coil winding has a distribution in the slots for producing a magnetic field having a strong pin-shaped field at the front end thereof and a barrel-shaped field at the rear end thereof.

3 Claims, 5 Drawing Figures

DEFLECTION COIL

BACKGROUND OF THE INVENTION

This invention relates to the deflection coil of a deflection yoke adapted to fit about a cathode ray tube, and more particularly to a deflection coil wound in a saddle-type configuration on the inside surface of a coil frame composed of a coil bobbin the front and rear ends of which are provided with guides having a plurality of circumferentially arrayed coil winding insertion slots, the wire of the coil being wound on the inside surface of the coil frame through the insertion slots.

As known deflection yokes of the type described, there can be mentioned, in general, a deflection yoke wherein the wires of both a horizontal deflection coil and vertical deflection coil are wound about a deflection core in a toroidal-type configuration, another in which the wires of both coils are wound along the length of the deflection core in a saddle-type configuration, and a third type in which the saddle configuration is adopted for the horizontal deflection coil and the toroidal configuration for the vertical deflection coil.

As an example of a deflection yoke in which at least one of the deflection coils possesses a saddle-type configuration, there is the invention disclosed in U.S. patent application No. 650,130 (Shizu), filed on Jan. 19, 1976 now U.S. Pat. No. 4,117,432. According to the disclosure, a coil frame is composed of a coil bobbin the front and rear ends of which are provided with guides having a plurality of circumferentially arrayed coil winding insertion slots, the deflection yoke being formed by winding a deflection coil wire directly on the inside surface of the coil frame through the insertion slots so as to form a saddle-type coil.

Thus, a deflection coil wound through the use of a coil frame is advantageous since the wires can be freely positioned. Even in a deflection coil of this type, however, there is still a need to adopt a construction suitable for improving upon misconvergence, cluster distortion, coma distortion, and the like.

SUMMARY OF THE INVENTION

Accordingly, it is the object of the present invention to provide a deflection coil which allows a desired magnetic field to be obtained, this being accomplished by a construction according to which the circumferential positions of wires of a deflection coil wound using a coil frame are altered and suitably arranged on the inside surface of the coil frame by changing the wire distribution at the front and rear ends of the coil frame.

Briefly, in accordance with the features of the deflection coil of the present invention, a coil frame comprises guides provided at the front and rear ends of a flared coil bobbin. Each guide has a plurality of circumferentially arrayed coil winding insertion slots. A plurality of wires passing through a single coil insertion slot in the guide at the rear end of the coil frame are arranged so as to pass through a plurality of coil winding insertion slots in the guide at the front end of the coil frame, the wires being wound in a saddle-type configuration on the inside surface of the coil frame, thereby forming a deflection coil.

DETAILED DESCRIPTION OF THE INVENTION

Figure 1:
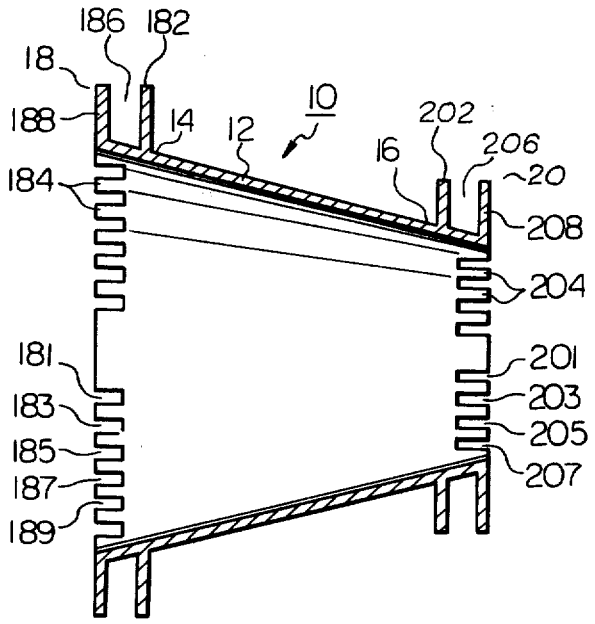
FIG. 1, showing a preferred embodiment according to the present invention, is a plan view of one-half of a coil frame, as seen from the inward side, employed in winding a deflection coil.

Referring now to FIG. 1, a coil frame 10 comprises a coil bobbin 12 made of an insulating material such as polyphenylene oxide and which is either a flared unitary body or a body constructed by combining a pair of divided flared members, as well as a pair of guides 18, 20 respectively provided at the front end (screen side) 14 and rear end (electron gun side) 16 of coil bobbin 12. The guides 18, 20 include ring-shaped collars 182, 202 and a multiplicity of circumferentially arrayed and suitably spaced finger members 184, 204 extending from the collars 182, 202 and defining therebetween a plurality of coil winding insertion slots 181, 183, 185, 187, 189, 201, 203, 205 and 207. Each finger member 184, 204 is formed to include at its end projections 188, 208 extending outwardly in the radial direction, the combination of collar 182 and projections 188, and the combination of collar 202 and projections 208 forming circumferentially extending annular channels 196, 206.

Figure 2:
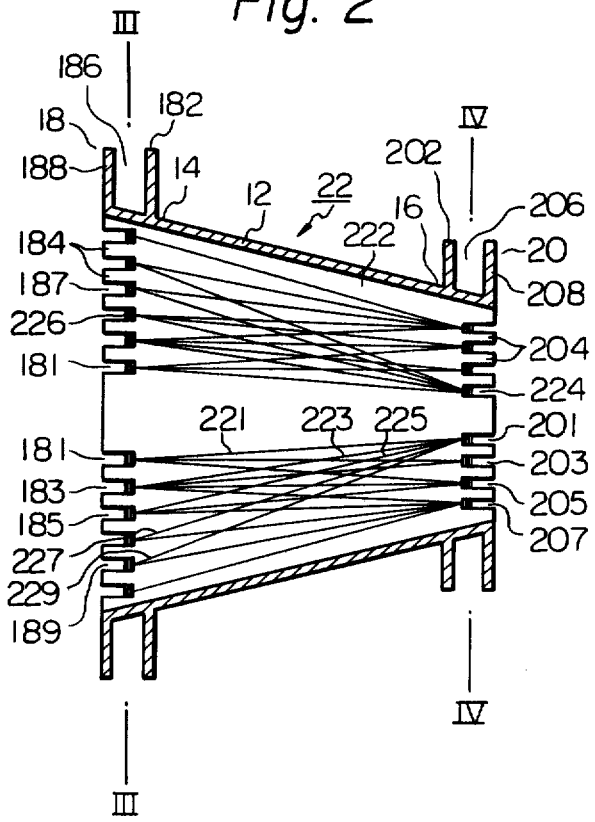
FIG. 2 shows a simplified view of a preferred embodiment of a deflection coil wherein only a portion of the coil wires are shown wound on the coil frame illustrated in FIG. 1.

FIG. 2 illustrates a deflection coil 22 which possesses a saddle-type configuration as wound on one-half of coil frame 10. Only a portion of the coil wires are shown in order to illustrate the wire distribution more clearly. Deflection coil 22 is wound in a saddle-type configuration by passing wires through coil winding insertion slots 181, 183, 185, 187, 189, 201, 203, 205 and 207 defined between the finger members 184, 204 of coil frame guides 18, 20 thereby disposing longitudinal portions 222 along the inside surface of coil frame 10, and by passing wires through the annular channels 186, 206 formed in guides 18, 20, thereby disposing transverse portions 224, 226 in the channels. The wires which form the deflection coil 22 on the coil frame 10 are wound in the following manner. A first wire 221, second wire 223, third wire 225, fourth wire 227 and fifth wire 229 passing through, for example, a first coil winding insertion slot 201 chosen from among the coil winding insertion slots 201, 203, 205, 207 in the guide 20 at the rear end of coil frame 10, are wound and hence positioned by being distributed so as to pass individually through a first coil winding insertion slot 181, second coil winding insertion slot 183, third coil winding insertion slot 185, fourth coil winding insertion slot 187 and fifth coil winding insertion slot 189 in guide 18 at the front end of coil frame 10. As a matter of fact, the number of the wires 221–229 are respectively varied within from one to twenty. The wires passing through the other coil winding insertion slots 203, 205, 207 of the rear guide 20 are positioned by being distributed among the coil winding insertion slots 181, 183, 185, 187, 189 of the front guide 18 in an entirely similar manner. Which of the front guide slots 181, 183, 185, 187, 189 that are to be used to position the wires passing through the rear guide slots 201, 203, 205, 207 is decided by the characteristics of the required magnetic field. Also, the number of wires passing through the rear guide slots 201, 203, 205, 207 varies from one to forty orders and is decided by the characteristics of the required magnetic field. In actual practice, a manufactured deflection coil may make use of a rear guide 20 having 36 slots and a front guide 18 having 52 slots.

Figure 3:
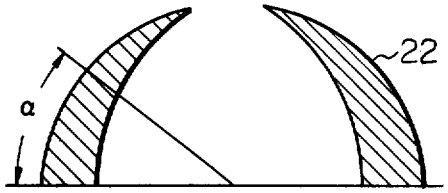
FIG. 3 is a simplified view of the wire distribution shown in cross-section where the deflection coil of FIG. 2 is sectioned along the front end of the coil frame.
Figure 4:
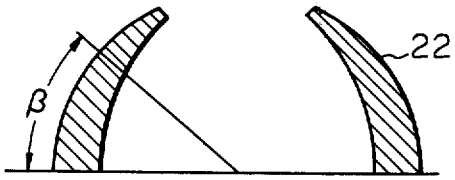
FIG. 4 is a simplified view of the wire distribution shown in cross-section where the deflection coil of FIG. 2 is sectioned along the rear end of the coil frame.

FIG. 3 illustrates wire distribution density in terms of an integrated value for a cross-section taken along the front end of deflection coil 22, and FIG. 4 is a similar view for a cross-section taken along the rear end of the deflection coil. Pluralities of wires which form the deflection coil 22 are passed through each coil winding insertion slot 201, 203, 205, 207 formed in guide 20 at the rear end of coil frame 20, and are wound and hence positioned by being distributed among coil winding insertion slots selected from among the slots 181, 183, 185, 187, 189 formed in guide 18 at the front end of coil frame 10. Accordingly, the wires which form deflection coil 22 are wound at a winding distribution of approximately $\cos^2\alpha$ at the front end of the coil frame with respect to a winding angle $\alpha$, and approximately $\cos^{3/2}\beta$ at the rear end of the coil frame with respect to a winding angle $\beta$.

Figure 5:
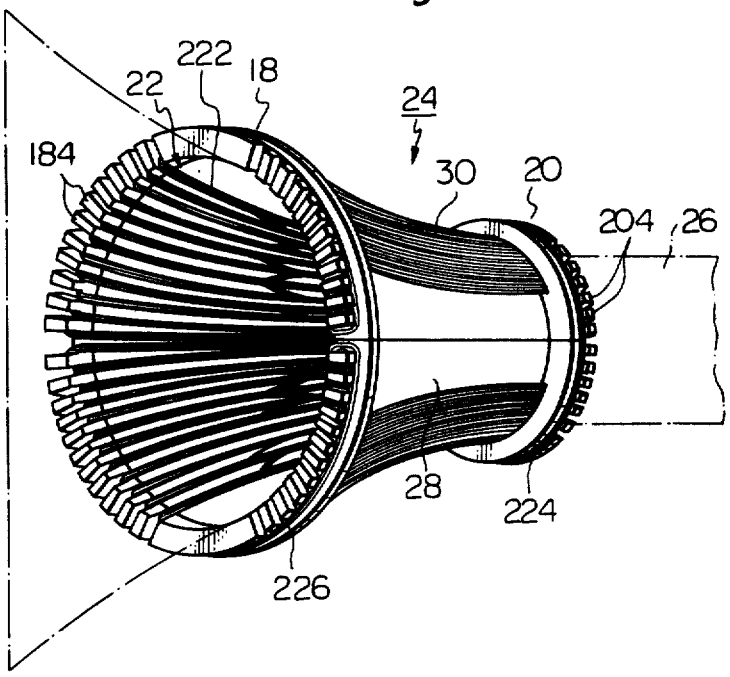
FIG. 5 is a perspective view, as seen from the front, of a deflection yoke which employs a pair of the deflection coils shown in FIG. 2, the deflection yoke being shown as it would appear if fit about a CRT.

FIG. 5 shows a deflection yoke 24 using the deflection coil 22 of the present invention as it would appear if fit about a CRT 26. Deflection coil 22 is employed as a horizontal deflection coil, and a toroidal-type vertical deflection coil 30 wound on a deflection core 28 is attached about the outer periphery of coil bobbin 12 of coil frame 10. According to this construction, the distribution of the magnetic field generated by horizontal deflection coil 22 is, as determined by the positions of the wires on the inside surface of coil frame 10, a strong, pin-shaped field at the front portion (screen side) of deflection yoke 24 and a barrel-shaped field at the rear portion (electron gun side) of the yoke in the case of a deflection yoke for a CRT where the wires are arrayed, for example, to bring an electron beam in line. In this case the deflection yoke can be constructed to give an axially directed deflecting magnetic field the overall shape of which tends toward a pin-shaped field. Such a deflection yoke is characterized by the absence or minimization of misconvergence, cluster distortion, coma distortion, and the like.

While the present invention has been shown and described with reference to a preferred embodiment in which the deflection coil of the invention is employed as the horizontal deflection coil of a deflection yoke, it should be understood that the deflection coil could equally well be used as a vertical deflection coil, and that various other changes or modifications may be made, without departing from the spirit or scope of the present invention.

What is claimed is:

1. A deflection coil comprising:

(a) a coil frame having a flared coil bobbin and guides provided at the front and rear ends of the coil bobbin and integrated therewith, wherein the guide at the front end of the coil frame has a first plurality of circumferentially spaced coil winding insertion slots therein and the guide at the rear end of the coil frame has a second plurality of circumferentially spaced coil winding insertion slots therein, the first plurality of slots being greater than the second plurality of slots, and (b) saddle-type coil means along the inside surface of the coil frame having a plurality of wires passing through predetermined coil winding insertion slots in the guide at the front and rear ends of the coil frame, and having a distribution in said slots for producing a magnetic field having a strong pin-shaped field at the front end thereof and a barrel-shaped field at the rear end thereof and for reducing misconvergence.

2. The deflection coil according to claim 1, wherein the coil frame comprises a pair of coil frame halves fitted together.

3. The deflection coil according to claim 1, wherein the coil frame comprises a flared, unitary body.

* * * * *